US009032897B2

(12) United States Patent
Argo

(10) Patent No.: US 9,032,897 B2
(45) Date of Patent: May 19, 2015

(54) PLANING HULL EXTENSIONS FOR WATERCRAFT

(71) Applicant: Randy Argo, Mohave Valley, CA (US)

(72) Inventor: Randy Argo, Mohave Valley, CA (US)

( * ) Notice: Subject to any disclaimer, the term of this patent is extended or adjusted under 35 U.S.C. 154(b) by 45 days.

(21) Appl. No.: 13/926,556

(22) Filed: Jun. 25, 2013

(65) Prior Publication Data

US 2013/0340666 A1 Dec. 26, 2013

Related U.S. Application Data

(60) Provisional application No. 61/663,715, filed on Jun. 25, 2012.

(51) Int. Cl.

| | |
|---|---|
| ***B63B 1/22*** | (2006.01) |
| ***B63B 1/18*** | (2006.01) |
| *B63B 39/06* | (2006.01) |

(52) U.S. Cl.

CPC ... *B63B 1/22* (2013.01); *B63B 1/18* (2013.01); *B63B 2039/067* (2013.01); *B63B 2001/183* (2013.01)

(58) Field of Classification Search

CPC ..... B63B 1/22
USPC ..... 114/271, 282–285
See application file for complete search history.

(56) References Cited

U.S. PATENT DOCUMENTS

| | | | | |
|---|---|---|---|---|
| 2,991,747 | A * | 7/1961 | Bader et al. | 114/282 |
| 6,105,527 | A * | 8/2000 | Lochtefeld et al. | 114/125 |
| 6,895,883 | B2 * | 5/2005 | Coles | 114/288 |
| 7,174,843 | B1 * | 2/2007 | Tossavainen | 114/284 |
| 8,051,793 | B2 * | 11/2011 | Ulgen | 114/274 |
| 8,122,840 | B2 * | 2/2012 | Harper | 114/61.32 |
| 8,453,591 | B2 * | 6/2013 | Mannerfelt et al. | 114/272 |
| 8,539,897 | B1 * | 9/2013 | Gasper et al. | 114/284 |
| 2013/0340666 | A1 * | 12/2013 | Argo | 114/284 |

* cited by examiner

*Primary Examiner* — Lars A Olson
*Assistant Examiner* — Jovon Hayes
(74) *Attorney, Agent, or Firm* — Canady & Lortz LLP; Bradley K. Lortz

(57) ABSTRACT

Planing hull extensions for watercraft are disclosed which may be mounted along the sides of the hull of a watercraft such as a boat or yacht. Typically, the hull extensions may be disposed along the side chines of the hull such that they extend the effective beam of the hull. The hull extensions may aid stabilizing the watercraft and/or inhibit wetting of the sides of the hull as well. In some cases, the hull extensions may be hydraulically operated between a closed position against the hull (or into a pocket along the side of the hull) and a fully open position substantially extending the width of the hull bottom. The position of the hull extensions may be automatically varied based upon throttle position, e.g. fully open at low throttle to fully closed against the hull at full throttle. Different hull extension position profiles may be used according to loading and water conditions.

19 Claims, 5 Drawing Sheets

PLANING HULL EXTENSIONS FOR WATERCRAFT

CROSS-REFERENCE TO RELATED APPLICATION

This application claims the benefit under 35 U.S.C. §119(e) of the following U.S. provisional patent applications, which are incorporated by reference herein:

U.S. Provisional Patent Application No. 61/663,715, filed Jun. 25, 2012, and entitled "PLANING HULL EXTENSIONS FOR WATERCRAFT", by Randy Argo.

BACKGROUND OF THE INVENTION

1. Field of the Invention

This invention relates to hulls for watercraft. Particularly, this invention relates to configurable hull extensions to effectively widen the beam of watercraft and provide more planing area over a water surface.

2. Description of the Related Art

The hull is the watertight body of a watercraft, which supports the superstructure (or deckhouse) above it. The hull structure varies based upon the type of watercraft. Modern boats may comprise fiberglass or composite hulls where the structure may include supporting bulkheads, typical of traditional designs, or comprise a monocoque structure. For watercraft to be trailerable over roadways, hull size is limited by law. For example, many states may limit the maximum beam width to eight and a half feet to operate without a permit.

Hull shape design for watercraft has an ancient history. There are many variations depending upon the application of the particular watercraft. Hull shapes can range from simple box shapes, e.g. for barges, to sharp streamlined surfaces, e.g. for racing boats. Typically, a hull shape may either have smooth curves, such as an S-bottom, molded, round bilged or soft-chined hull, or have at least one knuckle (or discontinuity), such as a chined hull.

Hull types may be further categorized as being either displacement or planing, or something between (i.e. semi-displacement or semi-planing). A displacement hull is supported predominantly by buoyancy. Such hulls have limited speed and are often heavier than planing hulls. On the other hand, planing hulls are designed to develop positive dynamic lift such that the hull draft decreases with increasing speed. The dynamic lift reduces the wetted surface of the hull and therefore reduces the drag of the hull as it moves through the water. Planing hulls may be flat-bottomed, V-bottomed, or round bilged. Typically, a planing hull will have at least one chine.

Another category of watercraft employs hydrofoils, which operate to lift a watercraft hull out of the water and virtually eliminate hull drag. The hydrofoil acts as a wing as water passes across both the top and bottom surfaces of the hydrofoil. This is very different from a planing hull where water substantially passes only across the bottom surface. A successful hydrofoil watercraft is designed to transition between a wetted hull and an unwetted hull as the watercraft develops speed and is lifted out of the water. Typically, watercraft employing hydrofoils are very expensive to develop as the engineering is much more complex than traditional watercraft. Some prior work has been done to alter hull configurations in both traditional and hydrofoil watercraft described hereafter.

U.S. Pat. No. 6,895,883 issued May 24, 2005 to Coles describes a hydrofoil craft, particularly a method of economically modifying a conventional hull with cambered foils to obtain and calculate increased lift from dense spray and to achieve enhanced craft performance is disclosed. The present invention improves speed, fuel efficiency and rough water stability, reduced pitch and vertical accelerations. A catamaran or V-bottom hull is modified with chine mounted aerofoils, flexible dihedral cambered foils positioned beneath the water line and on either side of the bow so as to create turbulence in the forward end of a tunnel(s). Fixed forward tunnel cambered foil(s) and/or fixed or adjustable center tunnel cambered foils at the stern end of the tunnel to generate lift from pressure caused by dense spray in the tunnel(s) may also be provided.

U.S. Pat. No. 7,174,843 issued Feb. 13, 2007 to Tossavainen describes a hydrofoil unit for attaching to the stern of the hull of a boat. The unit includes a mount that mounts to the stern of the hull of the boat, a hydrofoil that is pivotally attached to the mount, a pivot assembly that pivotally attaches the hydrofoil to the mount, and apparatus for pivoting the hydrofoil relative to the mount. In one embodiment, the apparatus is automatic and includes an hydraulic cylinder that is pivotally attached to the transom of the boat and a strut that is pivotally attached to the hydraulic cylinder and the hydrofoil. In another embodiment, the apparatus is manual and includes an upper threaded rod that is pivotally attaching to the transom of the boat, a turnbuckle that is attached to the upper threaded rod, and a lower threaded rod that is attached to the turnbuckle and the hydrofoil.

U.S. Pat. No. 7,520,238 issued Apr. 21, 2009 to Patterson describes a vessel hull stabilization system is presented that uses hydrofoils mounted on the vessel. The hydrofoils create a counteracting force to the waves that would otherwise cause the vessel to roll and pitch. The hydrofoil is connected to the vessel in both passive and an active modes. The hydrofoil consists of a number of configurations that include a number of attached struts and foils which provide additional counteracting forces in response to wave action.

U.S. Pat. No. 8,051,793 issued Nov. 8, 2011 to Ulgen describes a marine vehicle with at least one hydrofoil at the lower hull of such marine vehicle, and at least one drive element for retracting a pair of hydrofoils mounted side-by-side on both sides of the symmetry axis of the hull of the marine vehicle. When hydrofoils are in the retracted position, the marine vehicle is converted to a conventional marine vehicle.

U.S. Pat. No. 8,122,840 issued Feb. 28, 2012 to Harber describes an improved displacement hull form for ships and boats, in one of many possible embodiments includes a transom stern hull form having a hull underside that is substantially horizontal in transverse orientation along the aft-most portion of said hull form, a pair of endplates having a substantially vertical orientation along the aft half of said hull form waterline length, a pair of cambered rudders located near the stern of said hull form with said cambered rudders having pressure faces oriented towards said hull form longitudinal centerplane, and stern buttock-line shaping defined by a supercavitating hydrofoil shape. The hydrodynamics of said hull form are improved in terms of reduced resistance, reduced trim and draft aft, and reduced ship wave train.

In view of the foregoing, there is a need in the art for apparatuses and methods to provide more planing area for watercraft over a water surface. There is a need for such apparatuses and methods without the complexity and cost of hydrofoils. There is also a need for such techniques to be configurable to particular applications. In addition, there is further need for such apparatuses to operate without exceeding trailerable vehicle requirements. These and other needs are met by the present invention as described in detail hereinafter.

SUMMARY OF THE INVENTION

Planing hull extensions for watercraft are disclosed which may be mounted along the sides of the hull of a watercraft such as a boat or yacht. Typically, the hull extensions may be disposed along the side chines of the hull such that they extend the effective beam of the hull. The hull extensions may aid stabilizing the watercraft and/or inhibit wetting of the sides of the hull as well. In some cases, the hull extensions may be hydraulically operated between a closed position against the hull (or into a pocket along the side of the hull) and a fully open position substantially extending the width of the hull bottom. The position of the hull extensions may be automatically varied based upon throttle position, e.g. fully open at low throttle to fully closed against the hull at full throttle. Different hull extension position profiles may be used according to loading and water conditions.

A typical embodiment of the invention comprises an apparatus for a watercraft including a port hull extension extending from a port side of a watercraft hull such that a port hull extension side is attached along its length to the port side of the watercraft hull, and a starboard hull extension extending from a starboard side of the watercraft hull such that a starboard hull extension side is attached along its length to the starboard side of the watercraft hull. Each of the port hull extension and the starboard hull extension have a front end which yields lift under water flow to initiate planing as the watercraft hull begins moving. Typically, the port hull extension and the starboard hull extension may be disposed along chines of the watercraft hull. In some embodiments, the port hull extension and the starboard hull extension may each be supported by a plurality of struts affixed between a top surface and the watercraft hull. In some embodiments, the port hull extension and the starboard hull extension may extend aft of a transom of the watercraft hull.

In other embodiments, the port hull extension and the starboard hull extension may each be hinged to the watercraft hull along their lengths and mechanically moved between an open start position extending from the watercraft hull and an end position near the watercraft hull. The port hull extension and the starboard hull extension may be disposed against the watercraft hull in a closed position. The port hull extension and the starboard hull extension may be disposed in recesses along watercraft hull in the closed position. In some cases, the port hull extension and the starboard hull extension may be disposed in a downward chine configuration when in the open start position.

In some embodiments, the port hull extension and the starboard hull extension may be moved from the open start position extending from the watercraft hull to the end position near the watercraft hull as a throttle position of the watercraft is increased. Movement of the port hull extension and the starboard hull extension may be automatically controlled according to a profile based on the throttle position of the watercraft. In further embodiments, the profile may be selected based upon sea conditions. For example, the profile may direct a more open position of the port hull extension and the starboard hull extension corresponding to the throttle position with rougher sea conditions.

A typical method embodiment of the invention for configuring a watercraft hull may comprise providing hull extensions extending from port and starboard sides of a watercraft hull, each hinged to the watercraft hull along their lengths and mechanically movable between an open start position extending from the watercraft hull and an end position near the watercraft hull and each having a front end which yields lift under water flow to initiate planing as the watercraft hull begins moving, selecting a profile from a plurality of hull extension position profiles corresponding to throttle position, and moving the hull extensions according to the selected profile as the throttle position is changed. The method embodiment may be further modified consistent with the apparatus embodiments described herein.

BRIEF DESCRIPTION OF THE DRAWINGS

Referring now to the drawings in which like reference numbers represent corresponding parts throughout.

DETAILED DESCRIPTION

1.0 Overview

Figure 1A:
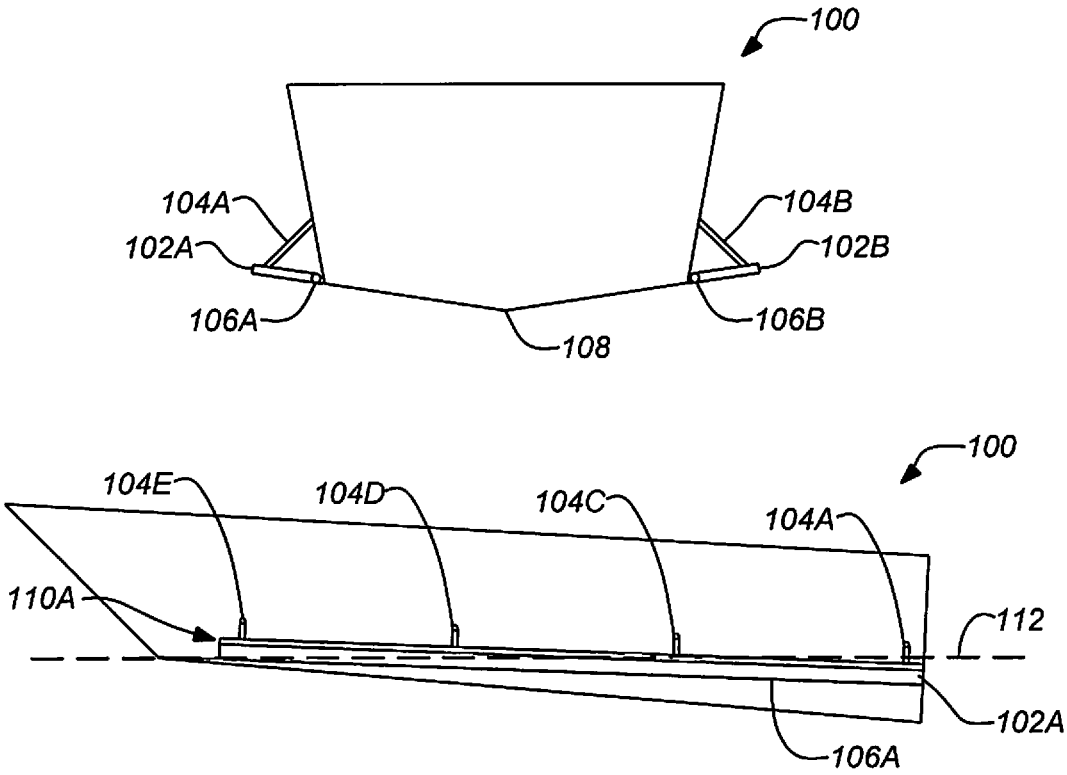
FIG. 1A is schematic drawing of fixed planing hull extensions in an exemplary embodiment of the invention.

To overcome the limitations in the prior art discussed above, and to overcome other limitations that will become apparent upon reading and understanding the specification, various embodiments of the present invention are directed to techniques for providing more planing area for watercraft over a water surface.

As previously mentioned, embodiments of the invention may comprise side of hull mounted and/or hydraulically operated planing and stability hull extensions for watercraft, such as boats or yachts. The hull extensions may be utilized when the loads of a planing hull are extreme and a more economical and stable ride is desired.

In addition, embodiments of the invention can provide improved stability of roll characteristics for the watercraft whether the watercraft is operating as planing or not. In all applications this occurs in virtually all sea states and mainly occurs during the initial transition from non-planing to a planing attitude by the watercraft.

Hull extensions in accordance with the present invention should not be confused with simple transom mount trim tabs known in the art that only lift the stern of the vessel and not the planing surface. In such applications there is a substantially fixed fulcrum point and drag substantially increases forward of this point as the vessel is accelerated from to the bow plowing through the water. The benefit of transom mount trim tabs are a diminishing return when left in one position during a set cruise attitude for extended periods of time. In contrast, embodiments of the present invention optimize hull lift and are not a planing aid but additional planing surface providing actual lift of the watercraft hull without adding unnecessary drag.

Typical hull extension embodiments of the invention may be designed for use on trailerable vessels, e.g. having ten foot wide beams or less. However, those skilled in the art will appreciate that embodiments of the invention are not limited to such. The hull designer may be able to incorporate a greater range of speed and weight parameters for economy, comfort and stability of the watercraft based on the improved planing capabilities when using hull extensions.

In a further embodiment of the invention, the hull extensions may extend aft of the transom to add more lift to the planning surface. The hull extensions still remain outside of the hull planing surface parallel to the side of the hull. In this embodiment, the added planing surface aft of the transom (to both the port and starboard mounted hull extensions) provides additional lift to the planing surface without a fulcrum point as occurs in a traditional trim tab application. The added planning surface aft of the transom can distribute more of the vessels displacement on more of the water surface and further reduce drag by lifting the transom in conjunction with the extensions forward of the transom along the chine.

In the following description including the preferred embodiment, reference is made to the accompanying drawings, which form a part hereof, and in which is shown by way of illustration a specific embodiment in which the invention may be practiced. It is to be understood that other embodiments may be utilized and structural changes may be made without departing from the scope of the present invention.

2.0 Planing Hull Extensions

A typical embodiment of the invention comprises two planar extensions, one disposed along the port side and another disposed along starboard side. The planar extensions are elongated and appropriately sized according to the desired performance characteristics for the length, breadth, draft of the attributes of the applicable watercraft. The planar extensions may be manufactured from any suitable material capable of withstanding the loads and environment of the particular watercraft application. For example, construction may be from any known structural materials suitable for marine applications, such as reinforced fiberglass, stainless steel, aluminum, and/or coated woods.

FIG. 1A is schematic drawing of fixed planing hull extensions in an exemplary embodiment of the invention. The top panel shows a view of the watercraft hull 100 from the stern, while the lower panel shows a view of the port side of the watercraft hull 100. (The starboard side is a mirror image of the port side of the watercraft hull 100.) In the example, a port hull extension 102A extends from a port side of a watercraft hull 100. One side of the port hull extension 102A is attached along its length to the port side of the watercraft hull 100. Similarly, a starboard hull extension 102B extends from a starboard side of the watercraft hull 100 and one side of the starboard hull extension 102B is attached along its length to the starboard side of the watercraft hull 100. Lengthwise hinged attachments 106A, 106B of each extension 102A, 102B to the hull 100 may be made with a single hinge joint, multiple separate hinges, or any other suitable mechanical hinge attachment known in the art. In an elementary version of the hull extensions, they may be attached to the sides of the watercraft hull 100 by struts 104A-104B between a top surface of the hull extensions 102A, 102B and the watercraft hull 100 in a fixed position when installed. In the case of removable hinged attachments 106A, 106B, the hinges may be readily separated by one or more removable pins as will be understood by those skilled in the art.

The fixed position of the hull extensions 102A, 102B may be manually adjustable using pins to hold a particular angle setting. However, the hull extensions 102A, 102B may be removed or moved to a closed position (e.g. folded against the watercraft hull 100) for transport. Typically, the hull extensions 102A, 102B may be disposed along the side chines of the watercraft hull 100 set at angles such that the planes of the hull extensions 102A, 102B match the respective planes of the adjacent hull bottom sections as shown. However, different settings may be used for different hull types, sea conditions and/or speed as will be discussed hereafter.

Each of the hull extensions 102A, 102B have a front end 110A, 110B which yields lift under water flow to initiate planing as the watercraft hull begins moving. At rest, the hull extensions, 102A, 102B may be beneath the waterline 112. However, as the watercraft begins moving, the front ends 110 of both hull extensions, 102A, 102B quickly lift above a waterline 112 of the watercraft hull 100 as they begin planing on the surface of the water.

Figure 1B:
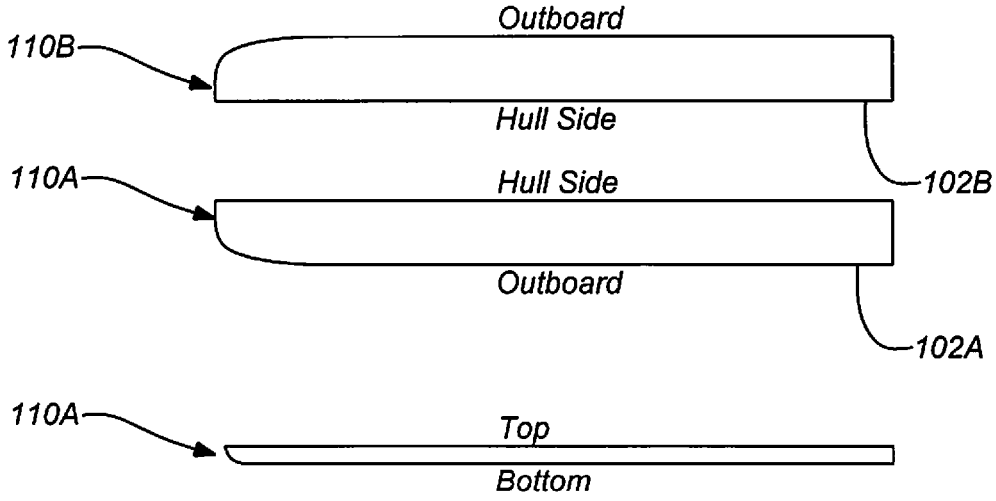
FIG. 1B shows details of example hull extensions detached from the watercraft hull.

FIG. 1B shows details of example hull extensions 102A, 102B detached from the watercraft hull 100. The upper view shows both hull extensions 102A, 102B side by side with the hull edges towards each other. Each hull extension 102A, 102B may be approximately one foot wide with a front end 110A, 110B that curves toward the hull when installed. The lower view shows a side view of both hull extensions 102A, 102B (which appear identical from the side). In this example for a relatively small vessel hull, the typical thickness of each hull extension 102A, 102B may vary depending on material composition from one sixteenth to one and a half inch. Thicker extensions may be employed on larger hull vessels. In addition, the front end 110A, 110B of each hull extension 102A, 102B may be rounded or beveled on the bottom side to aid planing as the extension moves over the water as shown in the lower view. Length of the hull extensions 102A, 102B may vary, but will typically be approximately 50% or more the overall length of the applicable planning surface. Length may be extended to aid optimum shedding of water off the hull. In addition, typical length of the hull extensions 102A, 102B may be such that the front ends 110A, 110B are slightly above the water line with the vessel at drift to aid planing and stability of the vessel. The hull extensions 102A, 102B are typically disposed with a slight upward angle toward the bow of the vessel.

Figure 1C:
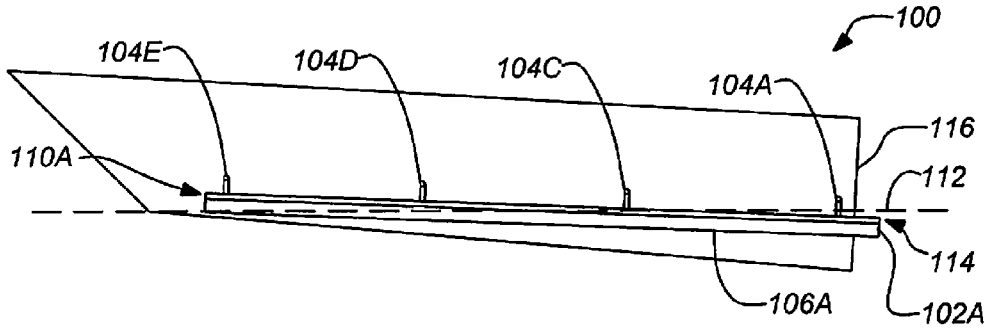
FIGS. 1C and 1D are schematic drawings of fixed planing hull extensions in a further exemplary embodiment of the invention extending aft of the transom shown in a side view and top view, respectively.
Figure 1D:
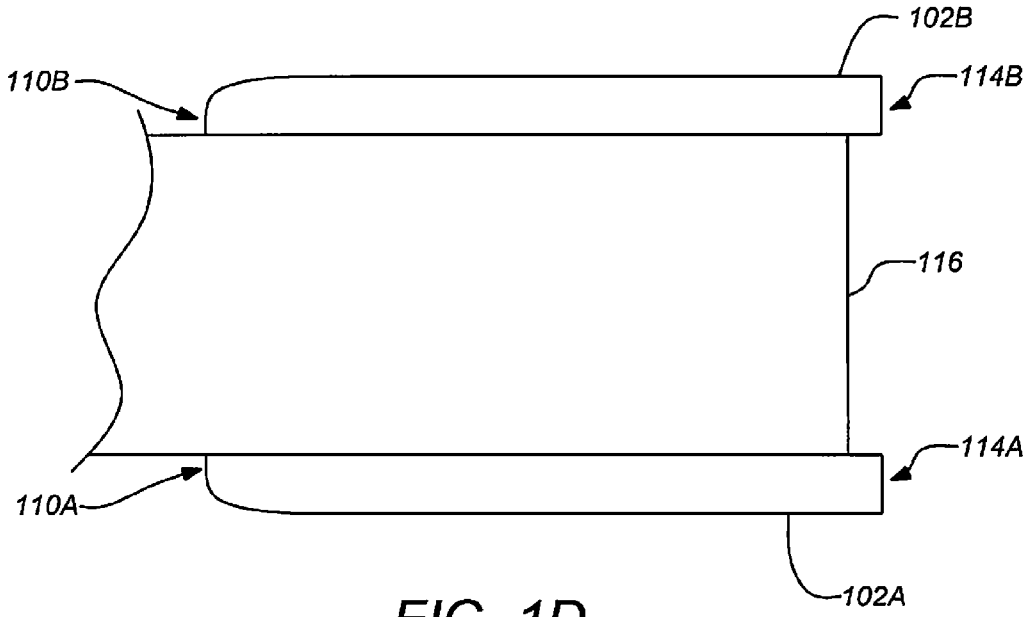

FIGS. 1C and 1D are schematic drawings of fixed planing hull extensions in a further exemplary embodiment of the invention having aft sections 114A, 114B extending aft of the transom shown in a side view and top view, respectively. These embodiments function as the extensions 102A, 10B previously described in reference to FIGS. 1A and 1B above but with some additional qualities. As previously mentioned, the hull extensions 102A, 102B can have aft sections 114A, 114B which extend aft of the transom 116 to add more lift to the planing surface while still being outside of the side hull planing surface parallel to the side of the hull 100. In this embodiment, the added planing surface aft of the transom 116, to the port and starboard mounted hull extensions 102A, 102B provide additional lift to the planning surface without a fulcrum point as would occur with a traditional trim tab. The added planning surface aft of the transom 116 can distribute more of the vessels displacement on more of the water surface and further reduce drag by lifting the transom 116 end of the hull 100 in conjunction with the extensions 102A, 102B forward of the transom 116 along the chine. These aft sections 114A, 114B may be employed with either fixed or reconfigurable extensions or any other embodiment of the invention described herein.

Embodiments of the invention can be used to optimize a balance between drag efficiency and ride comfort. This can bridge the tradeoff between fuel consumption in hull attitude versus forward momentum where the hull is otherwise incapable of providing adequate lift to facilitate reasonable fuel economy, i.e. where the hull begins to "push" water instead of planing on it.

Those skilled in the art can readily determine potential fuel savings applying simple drag and lift calculations for lengthy journeys employing time and route parameters. The optimum speed may be increased and fuel consumption reduced from the reduced drag provided by the hull extensions. The hull extensions can reduce the pushing of water and allow the watercraft to plane at an optimum lower fuel consumption engine rate. The fuel savings and optimum engine rate may also be determined through trial and error utilizing a fuel flow reading.

In addition, an embodiment of the invention can (proportionate to its engineered size) substantially expand the design limits for loads placed in higher areas above the waterline such as in the case of a fly bridge or tower configuration on any watercraft. The allowable height for an example 30' length by 10' wide beam watercraft is limited by the characteristics of its hull design and subject to displacement limitations that have severe consequences to fuel efficiency and ride comfort. In one example, hull extensions can be used to extend the planing surface width of the example watercraft up to two feet (each hull extension being one foot wide or more) but allow the vessel to still be towed on a trailer in most States when they are removed or retracted.

3.0 Reconfigurable Planing Hull Extensions

Figure 2:
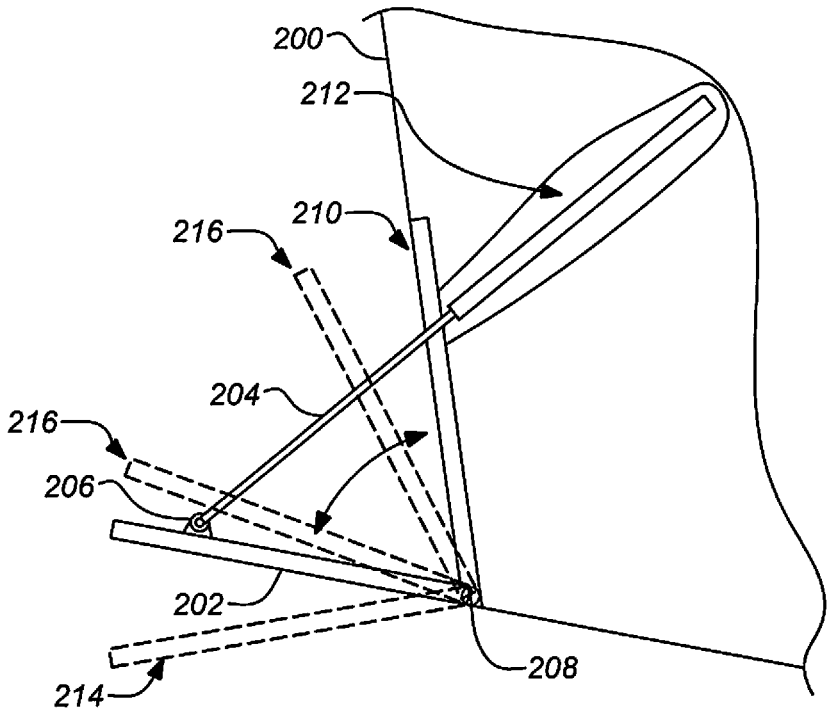
FIG. 2 is schematic drawing of configurable planing hull extensions in another exemplary embodiment of the invention.

FIG. 2 is schematic drawing of adjustable planing hull extensions in another exemplary embodiment of the invention. (Note: only a close-up cutaway view of the port side hull extension from the aft end is shown in FIG. 2. The starboard side is a mirror image and the overall installation is as shown in the fixed position embodiment of FIG. 1. The hull extensions are positioned symmetrically.) The hull extension 202 is attached along one side to the watercraft hull 200 with hinge 208. A mechanical actuator 204 (e.g. a hydraulic actuator) is attached to a hinge point 206 distal from the hinge 208 such that the actuator 204 may push or pull the hinge point 206 to adjust the position of the hull extension 202. The actuator 204 mechanism may be disposed within the watercraft hull 200 but may be sealed within a bladder or cavity 212 to prevent any leakage into the interior of the hull 200.

In some cases, the watercraft hull 200 may be designed with recesses 210 for each hull extension 202 to fold into in a closed position. It should be noted that the closed position may be the end position for the hull extension 202 in use, but not necessarily. In some cases, the closed position (e.g. in a recess 210 against the hull 200) may only be used when the hull extension 202 is not in use. In some cases, the end position 216 may be slightly deployed from the closed position as shown in phantom. The operational range of motion for the hull extension 202 depends upon the particular application (e.g. vessel loading and hull) as well as water conditions. For example the fully open position for the hull extension 202 may be such that the hull extension 202 matches the respective plane of the adjacent hull bottom sections as shown (referenced hereafter as "hull matching" position). However, in some applications, the fully open position may be such that the hull extension is disposed in a "reverse chine" position 214, past the plane of the adjacent hull as shown in phantom, or even a "chine" position 216, at an angle less than the plane of the adjacent hull. These positions are variable depending upon the hull, sea conditions, and the determined performance requirements.

The reconfigurable version of the hull extensions greatly expands their benefits and capabilities. In this case, the port hull extension and the starboard hull extension may each be hinged to the watercraft hull along their lengths and hydraulically moved between a start position fully open extending from the watercraft hull and an end position near the watercraft hull (which may be the closed position). This adjustability of the position of the hull extensions allows for tuning of the hull based upon sea conditions and/or speed of the watercraft. In the closed position, hull extensions may be disposed against the watercraft hull. In some cases, the hull extensions may be disposed in recesses along watercraft hull in the closed position.

With reconfigurable hull extensions, the hull extensions may be moved from the start position fully open extending from the watercraft hull to the end position extending near the watercraft hull (which may be the closed position) as a throttle position of the watercraft is increased. Movement of the hull extensions may be automatically controlled according to a profile based on the throttle position of the watercraft. Computerized optimum performance profiles may be tuned for the particular watercraft and programmed into any suitable known engine packages. In further embodiments, the profile may be selected based upon sea conditions. For example, some profiles for rougher sea conditions may direct a more open position of the hull extensions than other profiles for the same corresponding throttle position.

Figure 3:
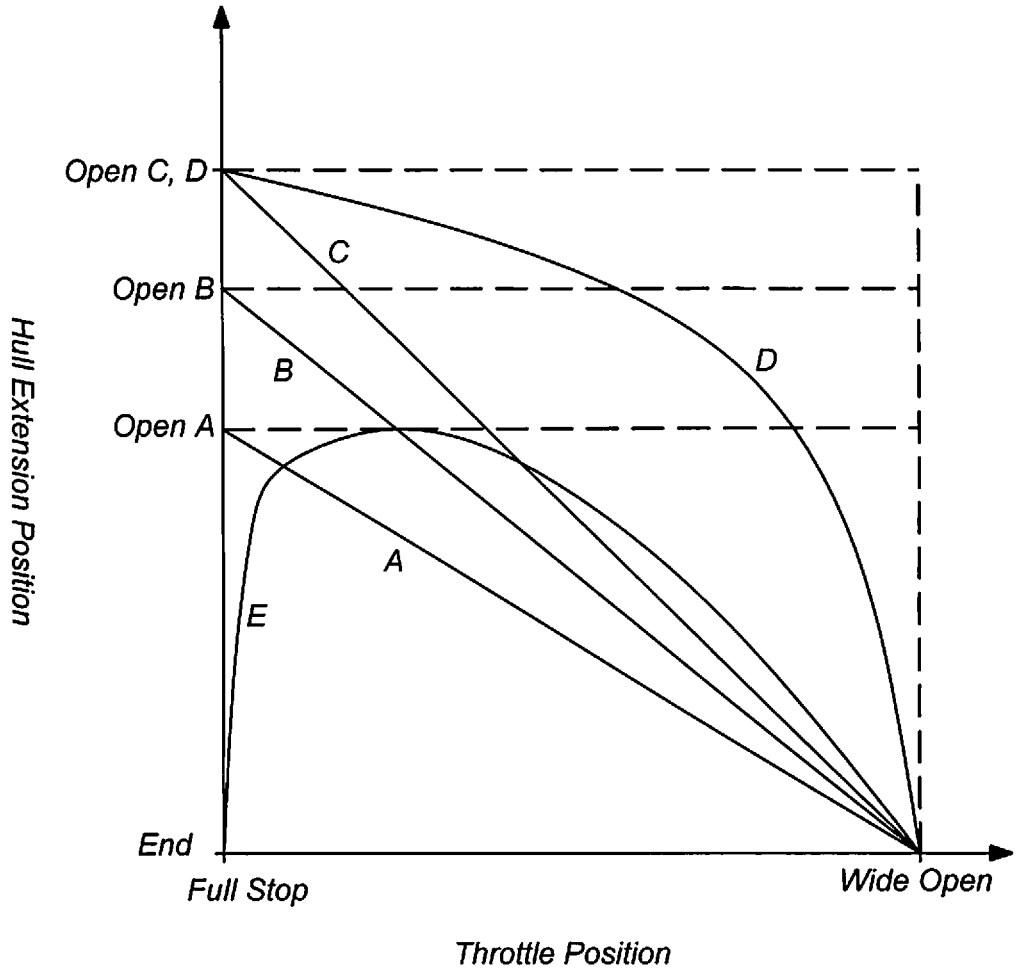
FIG. 3 shows example hull extension position versus throttle position profiles for different water conditions and/or performance.

FIG. 3 shows example hull extension position versus throttle position profiles A-E for different water conditions and/or performance. As previously discussed, the start position may be fully open extending from the watercraft hull in plane with the adjacent hull at a greater or lesser angle from that for a particular application or functional profile of the hull extensions (in either hull matching, reverse chine or chine position, as previously discussed). The end position will be with the hull extension near the watercraft hull (which may also be the closed position folded into a hull recess). Profiles A-C are linear such that the hull extension position moves directly with the throttle position. Profile B may have an open start position which corresponds to the hull extension being in plane with the adjacent hull. Accordingly, the open start position of profile A is a "chine" position and the open start position of profile C is a "reverse chine" position. Having a more open maximum position, profiles B and C may be used in rougher sea conditions than profile A for example. Profile D illustrates one example of a non-linear profile such that the hull extension is moved more slowly in the beginning (a reverse chine start position in this case, but could alternately be hull matching or chine) and moved more rapidly to the end position at higher throttle levels. Profile E is even more unique; in this case, the hull extensions begin in the end position (perhaps closed in the recesses) and then are returned to the end position at full throttle. For profile E, the maximum open position (chine position in this case, but could alternately be hull matching or reverse chine) is achieved quickly and then withdrawn approaching full throttle. Profiles can take on any shape and other performance profiles may be readily developed for particular applications, conditions and performance as will be understood by those skilled in the art.

In general, the hull extensions may be positioned relative to the planing surface of the hull from an at drift attitude (open start position) to a cruise speed attitude (end position) where the outer chine from a perpendicular measurement from the keel in length of the hull is utilized for lift, planing or stability. The hull extensions can be designed to be mounted with a degree of lifting capability factored under the full load limits designed for the watercraft measured from the fore to the aft of this measurement that is different from the hull planing surface.

As described above, hull extension embodiments of the invention may also provide the benefit of operating as a roll damper for the watercraft when extended. Furthermore, the hull extensions may be positioned in an overextended position in some cases (i.e. with a downward chine attitude) to further improve anti-roll characteristics for the watercraft. On the smaller trailerable watercraft there may be substantial roll, particularly when the watercraft structure extends higher above the waterline. Thus, embodiments of the invention can enable structures such as a fly bridge and or a tower extended significantly above the waterline depending upon the purpose of the particular watercraft. For example, embodiments of the invention may allow a fly bridge (e.g. having 13'6" overall trailerable height or higher). To facilitate a watercraft to be towed on the roadways in the U.S. or in any region where such restrictions are imposed, an arch or tower may be attached to the watercraft as a retractable or detachable structure of the vessel to extending structure above the legal towing limits.

In some cases, the outer edge of the hull extensions may be positioned to create a downward chine affect and provide lift in an extreme actuated position at a substantially reverse angle relative to planar bottom of the watercraft to provide greater stability in reducing roll. Here, the hull extensions may be disposed in a downward chine configuration when in the open position.

Design of the hull extensions can be tailored to fit any watercraft application in either a retrofit or designed when manufactured to fit into recesses of the hull structure at a relative position in a relative parallel plane to the planing surface of the hull.

When incorporated into the structure of the hull a recess for each hull extension can be used enhance the hull lines when the hull extensions are fully retracted. The hinge lines for each hull extension may be concealed under the hull where they may be hidden from a side view or on the chine edge where they can be plainly seen. But the recessed elongated cavities that the hull extensions close into can be made to appear as though they are defined dimensional characteristics of the lines of the overall hull.

As a retrofit on an existing hull or a designed attribute manufactured into the hull, a watershed strake or outward protrusion can be incorporated to provide the benefit of a dryer ride and can serve as an air vortex generator to lessen drag. In the case of a manufactured design, the cavity in the hull recess can also be designed to aid shedding water from the aft of the hull shedding bleeding upward wake water away from the upper areas of the hull.

The actuating mechanisms for the hull extensions may be operated through a cam or any suitable mechanism and disposed within tubes or in any appropriate proportionate configuration to extend the device from a fully retracted secure closed position to a fully extended open position. The actuating mechanisms may be a hydraulic or screw actuator or any suitable actuating mechanism known to those skilled in the art. The actuating mechanisms are sealed from the interior of the watercraft. In one simple example, the actuating mechanisms may be located inside a gland in the watercraft and simply operate within the gland using a hydraulic line fitted through a mounting pad on the actuator.

The actuating mechanisms may be single stage or employ multiple stages depending on the extension range required. The actuating mechanisms should drive the hull extensions from the start position to the desired downward angle (or at least in plane with the hull bottom). Typically, at least two actuating mechanisms may be necessary to stabilize the fore and aft of each hull extension. Additional actuating mechanisms may be required depending upon the length of the extensions according to the loads placed on them.

4.0 Method of Adjusting Planing Hull Extensions

Figure 4:
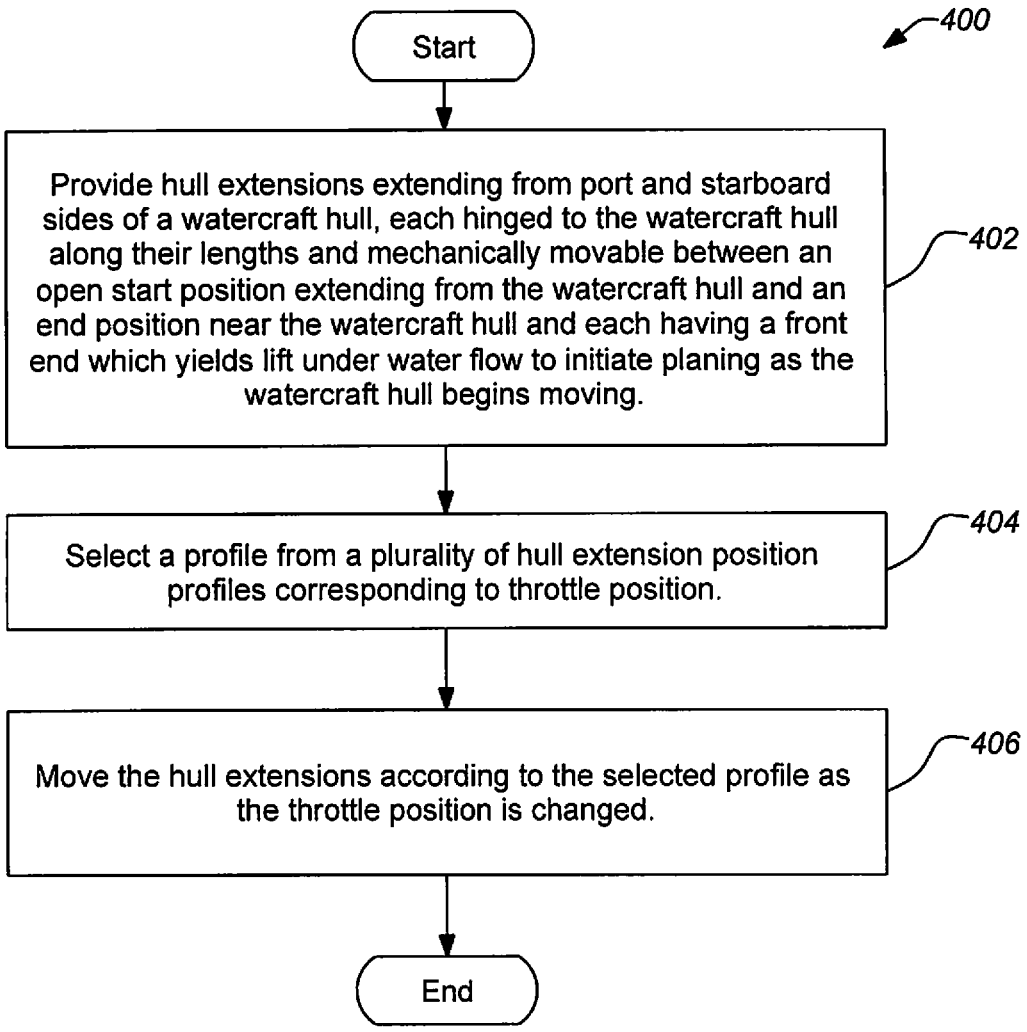
FIG. 4 is flowchart of an exemplary method of configuring a watercraft hull with adjustable hull extensions.

FIG. 4 is flowchart of an exemplary method 400 of configuring a watercraft hull with adjustable hull extensions. Operation 402 begins by providing hull extensions extending from port and starboard sides of a watercraft hull, each hinged to the watercraft hull along their lengths and mechanically movable between an open start position extending from the watercraft hull and an end position near the watercraft hull and each having a front end which yields lift under water flow to initiate planing as the watercraft hull begins moving. In operation 404, a profile is selected from a plurality of hull extension position profiles corresponding to throttle position. In operation 406, the hull extensions are moved according to the selected profile as the throttle position is changed. This method may be implemented using the reconfigurable hull extensions as previously described in section 3.0, e.g. FIGS. 2 and 3. In addition, this method 400 is also operable with hull extensions having aft sections extending aft of the transom.

The foregoing description, including the preferred embodiments of the invention, has been presented for the purposes of illustration and description. It is not intended to be exhaustive or to limit the invention to the precise form disclosed. Many modifications and variations are possible in light of the above teaching. The above specification provides a complete description of the apparatus, method and use of the invention.

What is claimed is:

1. An apparatus for a watercraft including:

a port hull extension extending from a port side of a watercraft hull such that a port hull extension side is attached along its length to the port side of the watercraft hull; and a starboard hull extension extending from a starboard side of the watercraft hull such that a starboard hull extension side is attached along its length to the starboard side of the watercraft hull;

wherein each of the port hull extension and the starboard hull extension have a front end which yields lift under water flow to initiate planing as the watercraft hull begins moving and the port hull extension and the starboard hull extension are each hinged to the watercraft hull along their lengths and mechanically moved between an open start position extending from the watercraft hull and an end position near the watercraft hull.

2. The apparatus of claim 1, wherein the port hull extension and the starboard hull extension extend aft of a transom of the watercraft hull.

3. The apparatus of claim 1, wherein the port hull extension and the starboard hull extension are disposed along chines of the watercraft hull.

4. The apparatus of claim 1, wherein the port hull extension and the starboard hull extension are each supported by a plurality of struts affixed between a top surface and the watercraft hull.

5. The apparatus of claim 1, wherein the port hull extension and the starboard hull extension are disposed against the watercraft hull in a closed position.

6. The apparatus of claim 5, wherein the port hull extension and the starboard hull extension are disposed in recesses along watercraft hull in the closed position.

7. The apparatus of claim 1, wherein the port hull extension and the starboard hull extension are disposed in a downward chine configuration in the open start position.

8. The apparatus of claim 1, wherein the port hull extension and the starboard hull extension are moved from the open start position extending from the watercraft hull to the end position near the watercraft hull as a throttle position of the watercraft is increased.

9. The apparatus of claim 8, wherein movement of the port hull extension and the starboard hull extension is automatically controlled according to a profile based on the throttle position of the watercraft.

10. The apparatus of claim 9, wherein the profile is selected based upon sea conditions.

11. The apparatus of claim 9, wherein the profile directs a more open position of the port hull extension and the starboard hull extension corresponding to the throttle position with rougher sea conditions.

12. A method of configuring a watercraft hull comprising the steps of:

providing hull extensions extending from port and starboard sides of a watercraft hull, each hinged to the watercraft hull along their lengths and mechanically movable between an open start position extending from the watercraft hull and an end position near the watercraft hull and each having a front end which yields lift under water flow to initiate planing as the watercraft hull begins moving;

selecting a profile from a plurality of hull extension position profiles corresponding to throttle position; and moving the hull extensions according to the selected profile as the throttle position is changed.

13. The method of claim 12, wherein the port hull extension and the starboard hull extension are disposed against the watercraft hull in a closed position.

14. The method of claim 13, wherein the port hull extension and the starboard hull extension are disposed in recesses along watercraft hull in the closed position.

15. The method of claim 12, wherein the port hull extension and the starboard hull extension are disposed in a downward chine configuration in the open start position.

16. The method of claim 12, wherein the port hull extension and the starboard hull extension are moved from the open start position extending from the watercraft hull to the end position near the watercraft hull as a throttle position of the watercraft is increased.

17. The method of claim 16, wherein movement of the port hull extension and the starboard hull extension is automatically controlled according to a profile based on the throttle position of the watercraft.

18. The method of claim 17, wherein the profile is selected based upon sea conditions.

19. The method of claim 17, wherein the profile directs a more open position of the port hull extension and the starboard hull extension corresponding to the throttle position with rougher sea conditions.

* * * * *